United States Patent [19]

Horikoshi et al.

[11] 4,389,123

[45] Jun. 21, 1983

[54] ELECTRONIC ALARM WATCH

[75] Inventors: Ichiro Horikoshi; Fumikazu Murakami; Yoshiaki Hara; Susumu Fujita; Osamu Ide, all of Tokyo, Japan

[73] Assignee: Kabushiki Kaisha Daini Seikosha, Tokyo, Japan

[21] Appl. No.: 195,931

[22] Filed: Oct. 10, 1980

[30] Foreign Application Priority Data

Oct. 18, 1979 [JP] Japan ..... 54/144279[U]

[51] Int. Cl.[3] ..... G04C 21/00

[52] U.S. Cl. ..... 368/250; 368/290; 340/388

[58] Field of Search ..... 368/250, 255, 290, 292, 368/291, 73, 71, 72; 340/89

[56] References Cited

U.S. PATENT DOCUMENTS

| | | | |
|---|---|---|---|
| 3,577,876 | 5/1971 | Spadini | 368/250 |
| 3,939,646 | 2/1976 | Uchiyama | 368/291 |
| 4,004,410 | 1/1977 | Kawamata | 368/291 |
| 4,075,828 | 2/1978 | Klingenberg | 368/292 |
| 4,197,697 | 4/1980 | Mori et al. | 368/250 |

FOREIGN PATENT DOCUMENTS

| | | | |
|---|---|---|---|
| 54-97457 | 8/1979 | Japan | 368/255 |

*Primary Examiner*—Bernard Roskoski

*Attorney, Agent, or Firm*—Robert F. Burns; Emmanuel J. Lobato; Bruce L. Adams

[57] ABSTRACT

A waterproof construction around a miniature buzzer incorporated in an electronic alarm watch depends on a gasket alone. The construction is such that the gasket can secure a resonant plate without any storage of distortion in the resonant plate. This feature makes it possible to provide the electronic alarm watch having a stable performance for acoustic emission.

15 Claims, 9 Drawing Figures

ELECTRONIC ALARM WATCH

FIELD OF THE INVENTION

The present invention relates to a structure for securing a resonant plate of a miniature buzzer assembly which is incorporated in an electronic alarm watch.

BACKGROUND OF THE INVENTION

In the conventional alarm watch, a resonant plate which is exposed to the open air and a watch case are sealed together by means of a gasket or adhesives for preventing moisture and dust from penetrating into the watch. Usually the gasket is selected so as to permit easy maintenance or easy fabrication. However in the conventional watertight structure using this type gasket, undesirable and harmful stresses are likely to be induced in the resonant plate resulting in deteriorated performance of the buzzer.

To avoid stressing and deformation of the resonatn plate requires precise finishing work for the buzzer assembly parts resulting in increased production costs.

SUMMARY OF THE INVENTION

In the present invention, the watch case is made waterproof by means of a gasket provided between the watch case and the resonant plate. The resonant plate is secured to a supporting frame by the gasket alone, and no part other than the gasket and the supporting frame makes contact with the resonant plate. The gasket is held in an annular groove provided in the watch case so that the gasket can not be forced out in a radial direction. The supporting frame is engaged with the watch case and fixed in place by means of caulking or a screw coupling.

Accordingly it is an object of the present invention to provide an improved waterproof electronic alarm watch. It is another object to achieve a stable performance for the acoustic emission produced by a buzzer incorporated in an electronic alarm watch.

It is a further object to reduce the manufacturing cost by doing away with the high accuracy in finishing work for the several parts relating to the buzzer performance such as is typically required in conventional electronic alarm watches. Other features and advantages of the invention will be apparent from the following description when taken in connection with the accompanying drawings.

DESCRIPTION OF PRIOR ART

Figure 1:
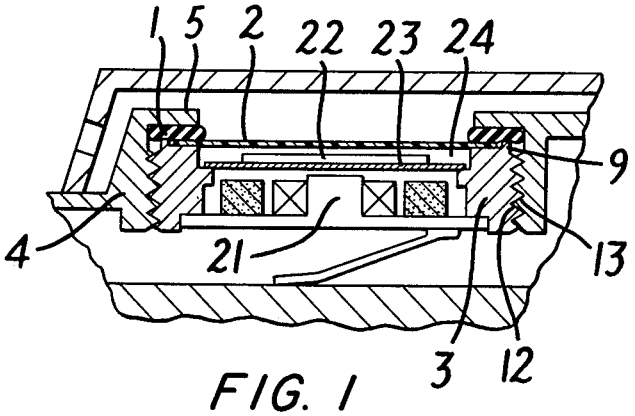
FIG. 1 PRIOR ART
FIG. 1 is a sectional schematic view of a miniature buzzer assembly of a conventional electronic alarm watch.

In the conventional electronic alarm watch illustrated in FIG. 1, a resonant plate 2 made of plastic material is supported at its periphery by a cylindrical supporting frame 3. A gasket 1 is disposed between the resonant plate 2 and an overhanging portion 5 of a watch case 4. The supporting frame 3 is engaged with the watch case 4 by means of a screw coupling 12,13. As the supporting frame 3 is advanced relative to the case 4 by means of the screw coupling axially, the overhanging portion 5 axially compresses the gasket 1 against the resonant plate 2. The resiliency of the compressed gasket 1 secures the resonant plate 2 to the supporting frame 3.

The resonant plate 2 produces sounds in a manner well known in the art. An alternating magnetic force generated by a driving unit 21 actuates an armature 22 mounted on a vibrating plate 23, and the vibration induced in the vibrating plate 23 is transmitted to the resonant plate 2 through an air spring which comprises an airtight space 24, and the mechanical vibration of the resonant plate is converted into an acoustic signal which is emitted from the surface of the resonant plate 2 to the exterior of the watch case.

Figure 2:
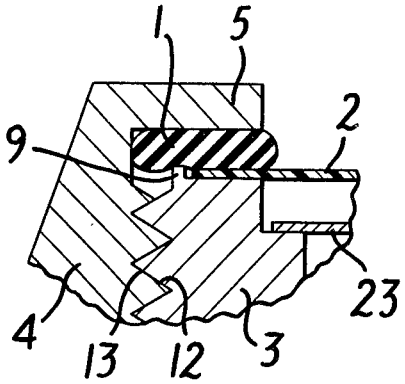
FIG. 2 PRIOR ART
FIG. 2 is an expanded fragmentary and schematic sectional view of the gasket area shown in FIG. 1.

As illustrated in FIG. 2, there are no means provided for stopping the supporting frame 3 from advancing too much or for preventing the gasket 1 from being pressed out radially in the conventional alarm watch structure. These problems make it quite difficult to control with any degree of precision the contact area between the gasket 1 and the resonant plate 2 in accordance with preselected dimensions and to accurately fix the effective diameter of the resonant plate 2.

The variations in the effective diameter cause variations in the characteristic frequency of the resonant plate 2, and such adversely affects the sound quality.

Figure 3:
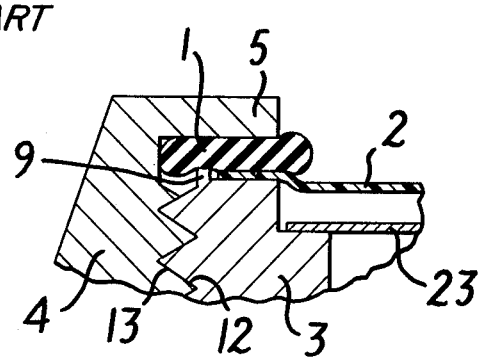
FIG. 3 PRIOR ART
FIG. 3 in comparison with FIG. 2 shows the radial deformation of the gasket when compressed strongly in the axial direction.

The above described trouble is schematically illustrated in FIG. 3. When there is an excess screwing of the supporting frame 3 into the watch case 4, the gasket 1 is unduly deformed and is pressed out radially too much.

Figure 4:
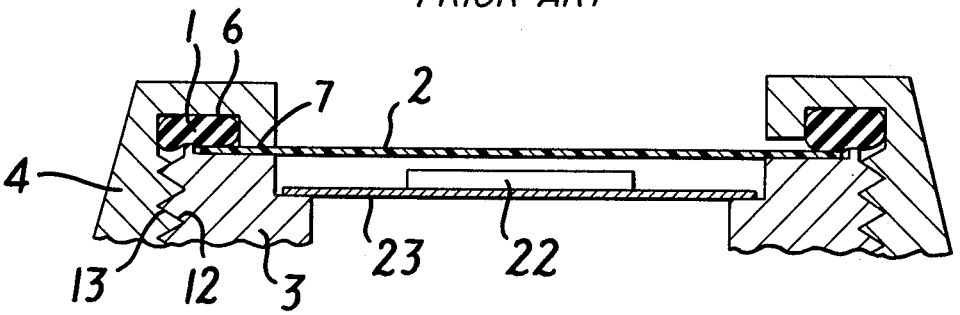
FIG. 4 PRIOR ART
FIG. 4 is a sectional schematic view of a miniature buzzer assembly of another conventional electronic alarm watch having a resonant plate which makes irregular contact with the watch case.
Figure 5:
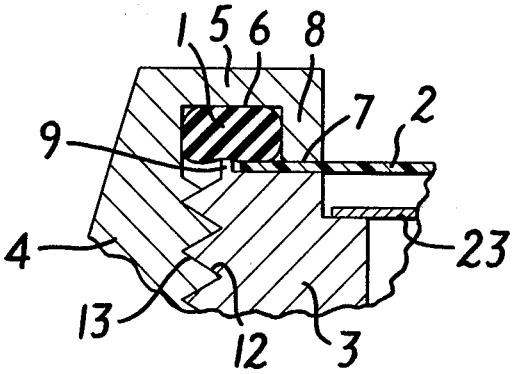
FIG. 5 PRIOR ART
FIG. 5 is an expanded fragmentary and schematic sectional view of the gasket area shown in FIG. 4.

Another conventional alarm watch structure for securing the resonant plate 2 is shown in FIG. 4 and FIG. 5 wherein the gasket 1 is held in an annular groove 6 provided in the overhanging portion 5 of the watch case 4, and the resonant plate 2 is made from extremely thin plastic film and is mounted on the supporting frame 3.

The supporting frame 3 is screwed into the watch case 4 until the periphery of the resonant plate comes into contact with an end face 7 of a first wall 8 projecting from the overhanging portion 5 and surrounding the groove 6.

This configuration is generally effective for preventing undue deformation of the gasket 1 but causes other subsidary adverse effects.

For example, in case tiny projections remain on the end face 7 of the first wall 8 because of insufficient work-finishing, they are likely to scratch the peripheral surface of the resonant plate 2 and cause damage at the time the buzzer assembly is mounted into the watch case.

In case the flatness of the end face 7 is not completely accomplished or the cylindrical supporting frame 3 is not engaged with the watch case 4 in precisely a vertical relation to an imaginary plane which includes the annular end face 7 (this relation will be referred to hereafter as the perpendicularity of the cylindrical supporting frame 3), the resonant plate 2 fails to make full surface-to-surface contact with the end face 7 as schematically illustrated in the right half of FIG. 4. This irregular contact produces distortion and curvature of the resonant plate 2.

Moreover, when the watch case is accidentally compressed by being subjected to an external force, the resonant plate 2 becomes even more distorted. This distortion is permanent because of the tiny projections or because of the irregular contact despite removal of the external force.

For the same reasons, the distortion of the resonant plate 2 caused by variations in atomospheric temperature remains ever after the variations diminish.

In order to overcome the afore-mentioned drawbacks, it is necessary to make the end face 7 smooth like a mirror, to make it completely flat, and to achieve the excellent perpendicularity of the supporting frame 3. However it is practically impossible to do these workings. Even if such were possible, they would result in a significant increase in the cost of the watch to a great extent.

DESCRIPTION OF PREFERRED EMBODIMENTS

Figure 6:
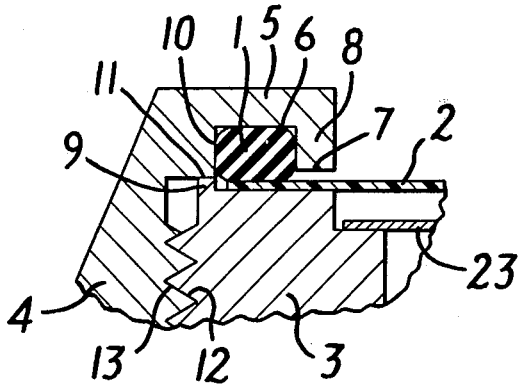
FIG. 6 is a sectional schematic view of an embodiment of the present invention.

FIG. 6 shows a greatly enlarged sectional view of the region around the gasket 1 in accordance with one typical embodiment of the present invention. The resonant plate 2, which in this embodiment is about 8 mm in diameter and 40 μm in thickness, is supported at its periphery by the supporting frame 3 and is guided in place by a guide projection 9 projecting from the upper end face of the supporting frame 3. The annular groove 6 provided in the overhanging portion 5 of the watch case 4 retains the O-ring shape gasket 1 which is made of elastic materials. The supporting frame 3 is provided with a male thread 12 on the outer cylindrical surface thereof and the male thread is screwed into a female thread 13 provided on the cylindrical inner surface of the watch case 4. The supporting frame 3 can be inserted to the limit where the guide projection 9 comes into contact with and abuts an end 11 of a second sidewall 10 which forms the groove 6 in co-operation with the first sidewall 8.

The end face 7 of the first sidewall 8 is shorter than the second sidewall 10 and is spaced away from the resonant plate 2. Consequently the resonant plate 2 is secured to the supporting plate 3 by the gasket 1 alone and not by the direct action of, or direct engagement with, the supporting frame 3.

In FIG. 6, the driving unit and other standard parts are not disclosed because they are of a conventional nature and need not be further described. Also, the way the miniature buzzer according to the present invention operates has not been disclosed for the same reason. A description will now be given as to how to mount the buzzer into the watch case 4. When the buzzer unit is screwed into the watch case 4, at first the resonant plate comes into contact with the bottom of the gasket 1 held in the groove 6. Further insertion of the buzzer unit causes elastic deformation of the gasket 1 into a compressed shape. Finally the guide projection 9 makes contact with the end 11 of the second sidewall 10 and stops advancing forward.

At this time, the gasket 1 is resiliently compressed against the peripheral portion of the resonant plate 2 at maximum pressure and is deformed into the groove 6 so as to accomplish the air-tight and waterproof seal of the buzzer unit.

In this embodiment the first sidewall 8 does not function as a stopper against the supporting frame 3 while the second sidewall 10 does. The tiny projections projecting from the end face of the first sidewall 8 can not cause any scratching of the resonant plate surface because the end face 7 is spaced apart from the resonant plate 2 and moreover, no contact exists between the end face 11 of the second sidewall and the guide 9 which could cause distortion and curvature of the resonant plate 2 because the resonant plate is not sandwiched therebetween. Even if the watch case is compressed by a temporary external force applied thereto and even if the resonant plate is distorted in response to the induced stress caused by the external force, the deviated peripheral portion of the resonant plate 2 returns frictionally to its orginal position after the removal of the external force. In the same manner, the distortion caused by variations in atmospheric temperature diminishes after the temperature becomes stable.

These features make it possible to secure the resonant plate flatly without regard to the smoothness and flatness of the watch case in any portion, and without regard to the perpendicularity of the cylindrical supporting frame. These features also prevent the resonant plate from permanently retaining any distortion. These features also make it possible to reduce the manufacturing cost because a lesser degree of accuracy in finishing work is required than in conventional work. These features also make it possible to construct an electronic alarm watch having a stable performance for acoustic emission.

Figure 7:
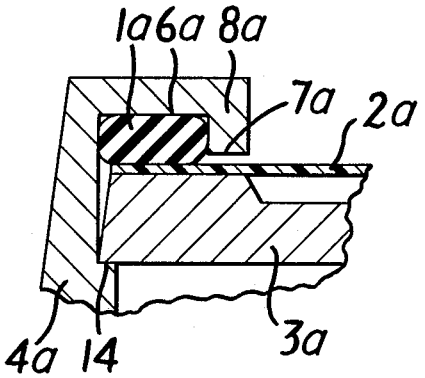
FIG. 7 shows a sectional view of another embodiment of the present invention.

FIG. 7 illustrates another embodiment wherein the buzzer unit is engaged with a ledge 14 provided on the inner surface of the watch case **4*a* by means of the resilience of the gasket 1*a* which is interposed and compressed between the overhanging portion of the watch case 4*a* and the resonant plate 2*a* instead of a screw coupling. The dimensions of the parts illustrated in FIG. 7 are designed to produce a resiliency in the gasket 1*a* which secures the resonant plate 2*a* to the supporting frame 3*a* and are designed to give a slight space between the end face 7*a* and the resonant plate 2*a***.

It is obvious that the same effect is obtained through this embodiment as in the case of the first embodiment shown in FIG. 6.

Figure 8:
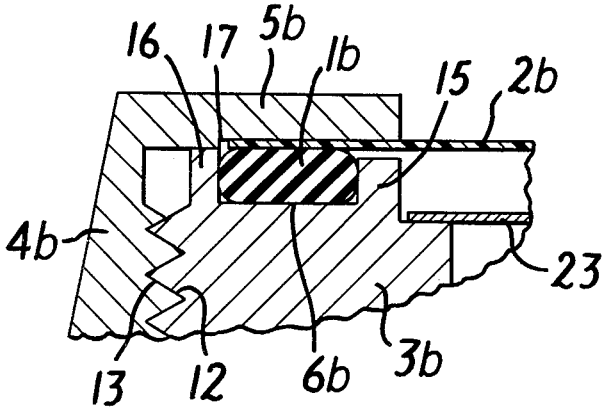
FIG. 8 and FIG. 9 show sectional view of further embodiments of the present invention.
Figure 9:
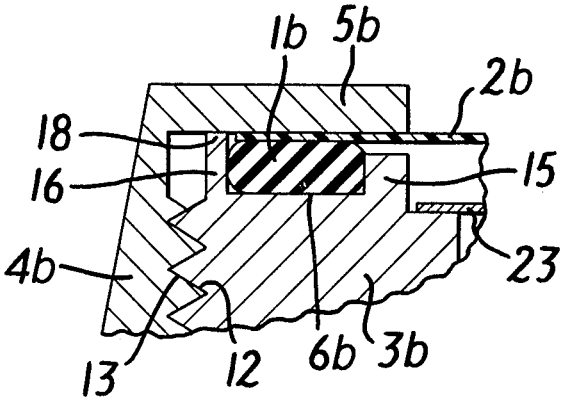

FIG. 8 and FIG. 9 illustrate further embodiments respectively wherein a groove **6*b* for holding a gasket 1*b* is provided on the upper end face of the supporting frame 3*b* in contrast with the first embodiment shown in FIG. 6. The resonant plate 2*b* is secured to an undersurface of the overhanging portion 5*b* solely by means the resiliency of the gasket 1*b*. The overhanging portion 5*b* and a secondwall 16 projecting from the supporting frame 3*b* make, contact to fix the supporting frame 3*b* in place and to leave a space between the supporting frame 3*b* and the first sidewall 15. The extent of compression of the gasket 1*b* and the position of the resonant plate 2*b* are determined by a ledge 17 provided on the overhanging portion 5*b* in FIG. 8, or by a secondwall 16 in FIG. 9**.

It is apparent that these features attain the objects of the present invention too.

The present invention is not limited to the preferred embodiments illustrated in the drawings but also includes many possible variations such as a single plate-type buzzer wherein the armature is mounted on the under surface of the vibrating plate and the vibrating plate is fixed at its periphery with the gasket. In the forgoing embodiments, the electro-magnetic buzzer has been taken as an example; however it is also possible to apply the present invention to a piezo-electric buzzer. It is also to be understood that the following claims are intended to cover all of the generic and specific features of the invention herein described and falling within the scope of the invention as defined in the claims.

What is claimed is:

1. In an electronic alarm watch having a resonant plate which is vibrationally driven during use of the watch for emitting an alarm sound: a supporting frame for directly or indirectly supporting a peripheral portion of the resonant plate so as to enable the plate to undergo vibration; a watch case; a gasket which contacts the resonant plate; the watch case having a portion which overhangs the gasket and which directly or indirectly axially compresses the gasket against the resonant plate; a recess defined by adjacent portions of the watch case and the supporting frame, the gasket being disposed in said recess and the recess being further defined by an annular outer sidewall in contact with the supporting frame and an annular inner sidewall which is spaced from and makes no contact with the resonant plate; and securing means for securing together the supporting frame and the watch case.

2. A watch as claimed in claim 1; in which the securing means secures together the supporting frame and the watch case by means of the resiliency of the gasket.

3. A watch as claimed in claim 1 or 2; in which the securing means comprises a screw coupling comprising a male thread on an outer cylindrical surface of the supporting frame and a female thread on an inner cylindrical surface of the watch case.

4. A watch as claimed in claim 1 or 2; in which the securing means includes a ledge on an inner cylindrical surface of the watch case to support and fix the supporting frame.

5. A watch as claimed in claim 1 or 2; in which the supporting frame directly supports the resonant plate, the gasket directly contacts the overhanging portion, and the overhanging portion is provided with a groove which forms part of said recess and in which the gasket is disposed.

6. A watch as claimed in claim 1 or 2; in which the supporting frame is provided with a groove which forms part of said recess and in which the gasket is disposed, and wherein the resonant plate directly contacts the overhanging portion.

7. A watch as claimed in claim 6; in which the overhanging portion has a guide groove for positioning the resonant plate.

8. In an electronic alarm watch having a resonant plate which is vibrationally driven during use of the watch to produce an alarm sound: a watch case having an overhanging portion which extends over a peripheral portion of the resonant plate; a supporting frame having a supporting portion which extends beneath the peripheral portion of the resonant plate; means defining a recess between the overhanging and supporting portions, said means defining a recess comprising annular inner and outer sidewalls connected to the watch case or the supporting frame, the inner and outer sidewalls being spaced apart from one another, and the inner sidewall being spaced from and making no contact with the resonant plate; a resiliently compressible gasket disposed in said recess between the peripheral portion of said resonant plate and either one of said overhanging portion or said supporting portion and between the inner and outer sidewalls, said gasket contacting the resonant plate peripheral portion; and securing means for securing together the watch case and supporting frame so as to effect resilient compression of the gasket within said recess between the resonant plate peripheral portion and said one of the overhanging and supporting portions.

9. A watch according to claim 8; wherein said means defining a recess comprises a groove in said overhanging portion defined by a pair of radially spaced-apart sidewalls which comprise said inner and outer sidewalls.

10. A watch according to claim 9; wherein the radially inward sidewall is shorter than the radially outward sidewall and is spaced a predetermined distance from and does not make contact with the resonant plate.

11. A watch according to claim 8, 9 or 10; wherein said securing means comprises abutting portions of the watch case and the supporting frame which are urged into abutment with one another by the compressed resiliency of the gasket to thereby secure together the watch case and the supporting frame.

12. A watch according to claim 8; wherein said means defining a recess comprises a groove in said supporting portion defined by a pair of radially spaced-apart sidewalls which comprise said inner and outer sidewalls.

13. A watch according to claim 12; wherein the radially inward sidewall is shorter than the radially outward sidewall and is spaced a predetermined distance from the resonant plate.

14. A watch according to claim 8, 12 or 13; wherein said securing means comprises a threaded connection.

15. A watch according to claim 8; wherein said gasket contacts the resonant plate peripheral portion and one but not the other of the watch case and the supporting frame.

* * * * *